US006973847B2

(12) United States Patent
Adams et al.

(10) Patent No.: US 6,973,847 B2
(45) Date of Patent: Dec. 13, 2005

(54) GYROSCOPIC ROLL STABILIZER FOR BOATS

(75) Inventors: John D. Adams, Lusby, MD (US); Shepard W. McKenney, Drayden, MD (US)

(73) Assignee: Gearloose Engineering, Inc., Solomons, MD (US)

( * ) Notice: Subject to any disclaimer, the term of this patent is extended or adjusted under 35 U.S.C. 154(b) by 172 days.

(21) Appl. No.: 10/454,905

(22) Filed: Jun. 4, 2003

(65) Prior Publication Data

US 2004/0244513 A1 Dec. 9, 2004

(51) Int. Cl.[7] ..... G01C 19/30; G01C 19/02; B63B 43/06

(52) U.S. Cl. ..... 74/5.47; 74/5.22; 114/121

(58) Field of Search ..... 74/5.22, 5 R, 5.1, 74/5.4–5.47, 5.5; 114/121–22

(56) References Cited

U.S. PATENT DOCUMENTS

| | | | | |
|---|---|---|---|---|
| 769,493 | A | | 9/1904 | Schlick |
| 769,693 | A | | 9/1904 | Forbes |
| 874,255 | A | | 12/1907 | Skutsch |
| 907,907 | A | | 12/1908 | Sperry |
| 919,004 | A | | 4/1909 | Haines |
| 989,958 | A | | 4/1911 | Frahm |
| 1,021,116 | A | | 3/1912 | Ure |
| 1,071,735 | A | | 9/1913 | Haagenson |
| 1,093,159 | A | | 4/1914 | Thomson |
| 1,150,311 | A | | 8/1915 | Sperry |
| 1,183,530 | A | | 5/1916 | Brennan |
| 1,186,339 | A | | 6/1916 | Schuler |
| 1,186,856 | A | | 6/1916 | Sperry |
| 1,232,619 | A | | 7/1917 | Sperry |
| 1,236,204 | A | | 8/1917 | Norden |
| 1,236,993 | A | | 8/1917 | Sperry et al. |
| 1,421,854 | A | | 7/1922 | Sperry |
| 1,558,720 | A | | 10/1925 | Thompson |
| 1,571,264 | A | | 2/1926 | Gretsch |
| 1,640,549 | A | | 8/1927 | Lamme |
| 1,655,800 | A | * | 1/1928 | Schein ..... 74/5.37 |
| 1,709,457 | A | | 4/1929 | Boykow |
| 1,730,941 | A | * | 10/1929 | Myers ..... 114/124 |
| 1,964,869 | A | | 7/1934 | Boykow |
| 2,046,735 | A | * | 7/1936 | Frisch et al. ..... 74/5.7 |
| 2,130,929 | A | | 9/1938 | Rocard |
| 3,576,134 | A | * | 4/1971 | Fersht ..... 74/5.22 |
| 3,944,840 | A | | 3/1976 | Troll |
| 4,200,168 | A | | 4/1980 | Moog |
| 4,458,554 | A | * | 7/1984 | Hrastar ..... 74/573 R |
| 5,203,727 | A | | 4/1993 | Fukui |
| 5,614,777 | A | | 3/1997 | Bitterly et al. |
| 5,628,267 | A | * | 5/1997 | Hoshio et al. ..... 114/122 |

(Continued)

FOREIGN PATENT DOCUMENTS

GB 1349777 * 4/1974

OTHER PUBLICATIONS

GG2479 Turn Rate Gyroscope, Honeywell International Inc. Brochure (Jul. 16, 2003).

(Continued)

*Primary Examiner*—Roger Pang
(74) *Attorney, Agent, or Firm*—Fish & Richardson P.C.

(57) ABSTRACT

A gyroscopic roll stabilizer for a boat. The stabilizer includes a flywheel, a flywheel drive motor configured to spin the flywheel about a spin axis, an enclosure surrounding a portion or all of the flywheel and maintaining a below-ambient pressure or containing a below-ambient density gas, a gimbal structure configured to permit flywheel precession about a gimbal axis, and a device for applying a torque to the flywheel about the gimbal axis. The flywheel, enclosure, and gimbal structure are configured so that when installed in the boat the stabilizer damps roll motion of the boat. Preferably, the flywheel drive motor spins the flywheel at high tip speeds.

17 Claims, 7 Drawing Sheets

U.S. PATENT DOCUMENTS

| | | | | |
|---|---|---|---|---|
| 5,632,222 | A | 5/1997 | Fido | |
| 5,816,098 | A | 10/1998 | Kanki et al. | |
| 6,162,314 | A | 12/2000 | Kassuelke et al. | |
| 6,427,616 | B1 * | 8/2002 | Hagen | 114/125 |
| 6,619,221 | B2 * | 9/2003 | Umemura et al. | 114/121 |

OTHER PUBLICATIONS

Ferry, "Gyroscopic Anti–Roll Devices for Ships," *Applied Gyrodynamics for Students, Engineers and Users of Gyroscopic Apparatus*, Chapter II, pp. 44–104 (1933).

Ferry, "Gyroscopic Anti–Roll Devices for Ships," *Applied Gyrodynamics for Students, Engineers and Users of Gyroscopic Apparatus*, Chapter IV, pp. 131–161 (1933).

Sperry, "The Gyroscope for Marine Purposes," Society of Naval Architects and Marine Engineers, New York (1910).

Sperry, "Active Type of Stabilizing Gyro," Society of Naval Architects and Marine Engineers, New York (1912).

Sperry, "Some Graphic Studies of the Active Gyro Stabilizer," Society of Naval Architects and Marine Engineers, New York (1913).

Sperry, "Recent Progress with the Active Type of Gyro–Stabilizer for Ships," Society of Naval Architects and Marine Engineers, New York (1915).

Burger et al., *Ship Stabilizers—A Handbook for Merchant Navy Officers,* Pergamon Press (1966).

Video of Mitsubishi Heavy Industries, Ltd., Anti–Rolling Gyro.

Mitsubishi Heavy Industries, Ltd., Anti Rolling Gyro MSM–2000 (2000).

Mitsubishi Heavy Industries, Ltd., Anti Rolling Gyro MSM–4000 (2000).

* cited by examiner

A
B
C
D
E
Wave Excitation Torque
Roll Velocity
Gyro Precession Angle θ
Wave Height
Roll Angle φ
Gyro Torque

S
16
V
L
θ

GYROSCOPIC ROLL STABILIZER FOR BOATS

TECHNICAL FIELD

This invention relates to devices for suppressing rolling motion in boats. For purposes herein "boats" refers to craft of all sizes, "small boats" refers to craft of less than 100 ft in length and less than 200 tons displacement and "ships" refers to all craft larger than "small boats".

BACKGROUND

Of all motions experienced on boats, movements about the roll axis are the most troublesome. On very small boats this is experienced immediately when passengers step off the dock onto the boat, as their weight causes a disturbing heel, and then rolling oscillation, of the hull. Even tied to a dock in otherwise calm water, wakes from passing boats can cause unexpected and rapid rolling motions, which cause the boat to slam against the dock, dangerous to boat and passenger alike.

Once the boat is underway, roll presents the most exaggerated and disorienting contrast to the stability of dry land. While pitch (except at very high speed) and heave of the hull generally conform to wave slope and height, roll tends to exhibit a magnification of wave slope. The reason is that the torque generated by the wave forces about the least stable axis of the hull creates an angular momentum which continues the rolling motion after the initial impulse has passed, resulting in heeling angles up to five times greater than wave slope. Moreover, because of the moment generated by the initial roll, the oscillation may continue for some time after the initial impulse has passed. The result is that, of all the motions a boat may exhibit, roll is the least desirable—leaving aside sinking. It is the most uncomfortable and tiring, and one of the greatest causes of motion sickness.

Fortunately, just as rolling motion requires the least energy to initiate, it also takes the least energy to damp, and the most successful boat motion suppression devices have been ones designed to address the roll problem, with most of the effort having been directed toward ships, where the economics justified the effort.

Prior to the early nineteenth century, motive power for boats was primarily sails, which, by their nature, provide a steadying moment—at least, as long as the wind blew. With the advent of steam power and the consequent absence of masts and sails, boat motion control became a more significant concern, and by the late nineteenth century, means were sought to stabilize ships in the roll axis.

The earliest (around 1870) attempts appear to be bilge keels—flat longitudinal plates extending diagonally from the sides of the bottom of the hull. These devices have limited effectiveness unless they are quite large and even then require significant boat speed so that the keels can generate lift by acting as foils.

The first (1880) successful dynamic roll control devices were slosh tanks—an arrangement of water containers inside the hull designed in such a way as to allow a large amount of water (typically 5 to 6% of vessel displacement) to shift from side to side in phase with the roll oscillation so as to damp the rolling impulse. Enhanced versions of this mechanism are used on ships being built at the present time. They are not practical for small boats because of their weight.

Movement of solid weights athwartship were tried briefly at the end of the nineteenth century, but were never considered successful enough to justify further development.

Actively controlled external fins were introduced in about 1925 (in effect, moveable bilge keels) and are the most widely used roll suppression devices on ships today. The fins, usually activated by hydraulic mechanisms, respond to the output of motion sensing devices so as to keep the damping effect of the fin lift in phase with the roll velocity of the vessel. They are generally effective only when the vessel is underway since the passage of water over the fins is necessary in order-for them to generate lift. Active fin systems are capable of stabilizing vessels at rest, but they require very large fins and an even larger energy budget.

Fin stabilizers have found wide application on ships, but not on small boats. One reason why is that ships tend to be underway at cruise speed most of the time when passengers are aboard, as compared to small boats, which are often occupied when at rest or at very low speed. Other reasons for fin stabilizers not being a good roll suppression solution for small boats is that they tend to be expensive, have high appendage drag (at least in planing boats, unless retractable), and are prone to damage from grounding or collision with objects in the water.

Another roll suppression device, used on displacement (but not planing) boats, including commercial fishing craft, is an arrangement of horizontal planing fins, called paravanes, rigged out on cables and booms on either side of the boat, so as to keep a stabilizing force acting on the hull from the lift generated by the planes moving through the water. They tend to be awkward and dangerous, unless used with skill and luck (snagging underwater objects can be nasty), and have found limited use, but at least demonstrate the lengths people will go to prevent boats from rolling. There is a similar system used for stabilizing a boat at rest which employs flat plates (in lieu of the fins) which resist being pulled up through the water column, and thus exert a damping effect in the roll axis. Because of their design, they cannot be used underway.

Gyroscopic roll stabilizers or control moment gyros are another class of devices used for roll suppression. Otto Schlick was the first to develop them, in 1906 (U.S. Pat. No. 769,493). A control moment gyro ("CMG") is a torque amplification device that uses controlled precession of stored angular momentum to produce large control torques in accordance with known laws of physics, commonly referred to as gyro dynamics. It is this torque that is used to damp roll in boat CMG installations. Ferry, *Applied Gyrodynamics*, Wiley (1933). The configuration and dynamics are as follows:

The angular momentum is stored in a spinning flywheel that is mounted in a one-degree-of-freedom gimbal, i.e., the spin axis of the flywheel is permitted to rotate about a gimbal axis, which is perpendicular to the spin axis and to the longitudinal axis of the boat. Usually, the spin axis of the flywheel is vertical, and the gimbal axis is athwartship, but those orientations can be reversed, so that the spin axis is athwartship, and the gimbal axis is vertical. When a boat employing a CMG rolls, conservation of the angular momentum of the flywheel causes the flywheel to rotate (or "process") about the gimbal axis. If the precession rate is controlled, a useful gyroscopic torque is imposed about the roll (longitudinal) axis of the boat, with the net effect that rolling motion is damped. Because the torque applied to the roll axis is many times the precessional torque, it can be sufficient to damp the roll motion. The damping effect is directly proportional to (a) the rate of rotation of the flywheel, (b) the mass of the flywheel, (c) the square of the radius of gyration of the flywheel and (d) the rate at which the gyro is precessed. There are, however, limits to the amount of damping that a CMG can provide. The precession torque applied about the gimbal axis produces a reactive torque about the roll (longitudinal) axis when the spin axis of the flywheel is vertical, but as precession angle grows, and the spin axis rotates closer to horizontal, the reactive torque also produces a yawing torque, and at a full 90 degrees of precession (when the spin axis is horizontal) the reactive torque is entirely about the yaw axis.

Although the idea of using CMGs to damp roll motion of boats is almost one hundred years old, there has been very little actual use of CMGs for this application. The principal use of CMGs in modem times has been in spacecraft positioning. A few ships were outfitted with CMGs in the early twentieth century (with perhaps the last major installation being of a Sperry CMG on the Italian cruise ship *Conto di Savoia* in 1932), but since then fin stabilizers have replaced CMGs. More recently, Mitsubishi produced a CMG for use on small boats. In the Mitsubishi product, a passive, rotary fluidic dashpot is employed to resist precession, and air resistance is relied on for limiting flywheel rpm. U.S. Pat. No. 5,628,267 was granted to Mitsubishi for this concept of relying on air resistance to limit flywheel rpm. The patent also discloses active braking of precession although this was originally disclosed in U.S. Pat. No. 1,150,311 granted to Elmer Sperry in 1915 and to others. Because of its large size and weight for the small boats for which it is intended, the Mitsubishi product has not sold well.

Why were CMGs, which enjoyed some early success on ships, supplanted by fin stabilizers? The most probable reason is that CMGs are rate devices. They can resist roll oscillation, but they cannot resist a continuing roll angle, e.g., a sustained heel caused by a turn, a large quartering wave, or a high beam wind—all common occurrences on ships. Fin stabilizers, on the other hand, can remain deflected as long as necessary to counter a continuing heeling moment. The fact that fin stabilizers are ineffective at low (or no) speed is not usually a problem for ships because when they are in a seaway large enough to affect them, they are normally at cruise speed. Thus while CMGs were effective on ships, they appear to have been surpassed by a competing technology with broader capabilities.

SUMMARY

We have discovered that CMG stabilizers can be improved by enclosing the flywheel in an enclosure that maintains a below-ambient pressure and/or contains a below-ambient density gas. We have also discovered that higher flywheel tip speeds, e.g., above 450 ft/sec on small boats and above 650 ft/sec on ships, can improve performance.

In a first aspect, the invention features a gyroscopic roll stabilizer for a boat, the stabilizer comprising a flywheel, a flywheel drive motor configured to spin the flywheel about a spin axis, an enclosure surrounding a portion or all of the flywheel and maintaining a below-ambient pressure, a gimbal structure configured to permit flywheel precession about a gimbal axis, and a device for applying a torque to the flywheel about the gimbal axis. The flywheel, enclosure, and gimbal structure are configured so that when installed in the boat, the stabilizer damps roll motion of the boat.

In a second aspect, the invention features a gyroscopic roll stabilizer for a boat, the stabilizer comprising a flywheel, a flywheel drive motor configured to spin the flywheel about a spin axis, an enclosure surrounding a portion or all of the flywheel and containing a below-ambient density gas, a gimbal structure configured to permit flywheel precession about a gimbal axis; and a device for applying a torque to the flywheel about the gimbal axis. The flywheel, enclosure, and gimbal structure are configured so that when installed in the boat the stabilizer damps roll motion of the boat.

In a third aspect, the invention features a gyroscopic roll stabilizer for a ship, the stabilizer comprising a flywheel, a flywheel drive motor configured to spin the flywheel about a spin axis at a tip speed of at least 650 ft/sec, a gimbal structure configured to permit flywheel precession about a gimbal axis, and a device for applying a torque to the flywheel about the gimbal axis. The flywheel, enclosure, and gimbal structure are configured so that when installed in the ship the stabilizer damps roll motion of the boat.

In a fourth aspect, the invention features a gyroscopic roll stabilizer for a small boat, the stabilizer comprising a flywheel, a flywheel drive motor configured to spin the flywheel about a spin axis at a tip speed of at least 450 ft/sec, a gimbal structure configured to permit flywheel precession about a gimbal axis, and a device for applying a torque to the flywheel about the gimbal axis. The flywheel, enclosure, and gimbal structure are configured so that when installed in the small boat the stabilizer damps roll motion of the boat.

In preferred implementations, one or more of the following features may be incorporated. The stabilizer may be configured and sized to be installed in a small boat. The flywheel drive motor may be configured to spin the flywheel about a spin axis at a tip speed of at least 650 ft/sec (preferably at least 850 ft/sec.) The enclosure may maintain a below-ambient pressure of less than 190 torr (preferably less than 7.6 torr, and more preferably less than 1 torr). The enclosure may maintain a below-ambient pressure and contain a below-ambient density gas. There may be a sensor for determining the spin rate of the flywheel and a controller for using the determined spin rate to control the flywheel drive motor and automatically regulate the flywheel spin rate. The device for applying a torque may comprise a passive precession brake. The device for applying a torque may comprise an active precession brake. The device for applying a torque may comprise a device for applying a torque to cause precession. The small boat may have a planing hull.

The invention can provide sufficient roll stabilization without the CMG being too large, too heavy, or requiring too much electrical power for the boats it is designed to stabilize. With an enclosure surrounding the flywheel, it is possible to reduce air friction on the flywheel, and thereby increase flywheel tip speed sufficiently to reduce the weight, size, and power requirements to levels practical for boats.

Air friction is a major factor contributing to the power required for spinning the gyro up, and the dominant factor in maintaining flywheel speed because air friction goes up with the cube of rpm. Heavier flywheels were more practical on ships than on small boats. The reason is that surface area goes down in relation to mass on heavy flywheels and air friction becomes an increasingly less significant factor in power requirements. But the invention's use of an enclosure for the flywheel can substantially reduce the power required to overcome air friction even on ship installations.

Larger flywheels also tended to have advantages in conventional CMGs, and this was a further reason why such stabilizers tended to be more practical for ships. For a given weight of the flywheel, increasing the diameter of the flywheel is the most energy efficient way to increase its angular momentum, and thus its effectiveness. The reason is that (all other things being equal) the angular momentum goes up with the square of the radius of gyration of the flywheel. Conversely, if the same results are to be achieved by turning a smaller diameter flywheel faster, more power is required because, while angular momentum goes up arithmetically with rpm, the power required to overcome air friction goes up with the cube of rpm. Ships can much more easily accommodate a CMG stabilizer with a suitably large flywheel than small boats can, which tend to have limited bilge space, particularly in the vertical dimension.

Finally, ships, with their extensive power plants, had large generators available to power CMG stabilizers, whereas many small boats have minimum electrical resources.

Thus, in the employment of CMG stabilizers, small boats were caught in a triangular quandary: The first side was that if the weight of the flywheel was increased, the device would be too heavy; the second side was that if the diameter of the flywheel was increased it would be too large for the available space, and the third side was that if the flywheel was spun faster, it would require too much power. Any one of these three considerations could be traded off for another, but collectively they formed a barrier to the employment of conventional CMG stabilizers in small boats.

The invention, at least in preferred implementations, addresses all three sides of the triangle. It allows the CMG stabilizer to be smaller, lighter, and require less power than its atmospheric predecessor.

By making it practical to employ CMG stabilizers in small boats, the invention opens the way to applying CMGs in an application for which they are well suited. Unlike the case with ships, small boat roll oscillations tend to be of short periods, making them amenable to the short-term corrective force of a rate device. Moreover, unlike ships, small boats tend to spend significant amounts of time at low (or no) speed in sea states that expose them to significant roll—a situation in which fin stabilizers are not effective.

DETAILED DESCRIPTION

There are a great many possible implementations of the invention, too many to describe herein. Some possible implementations that are presently preferred are described below. It cannot be emphasized too strongly, however, that these are descriptions of implementations of the invention, and not descriptions of the invention, which is not limited to the detailed implementations described in this section but is described in broader terms in the claims.

The descriptions below are more than sufficient for one skilled in the art to construct the disclosed implementations. Unless otherwise mentioned, the processes and manufacturing methods referred to are ones known by those working in the art.

Figure 1:
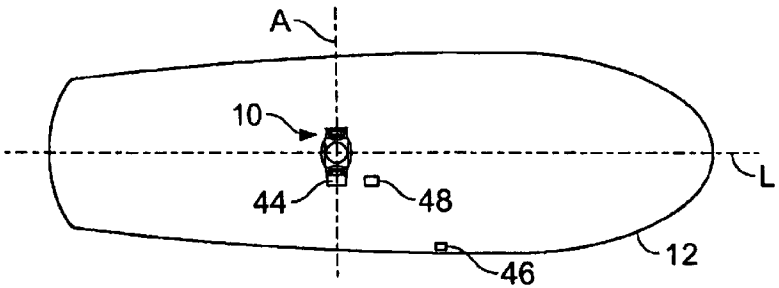
FIGS. 1–3 are plan, profile, and section views, somewhat diagrammatic, of a control moment gyro (CMG) roll stabilizer installed in a small boat with a planing hull.
Figure 2:
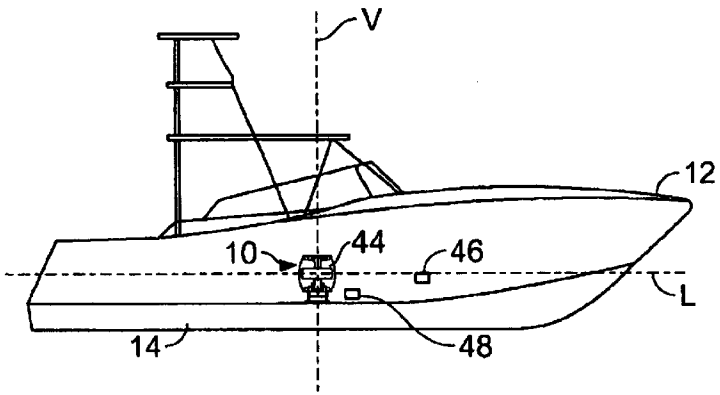
Figure 3:
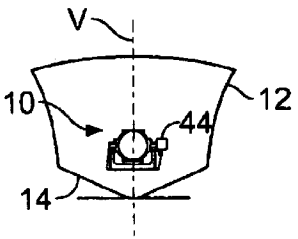
Figure 4:
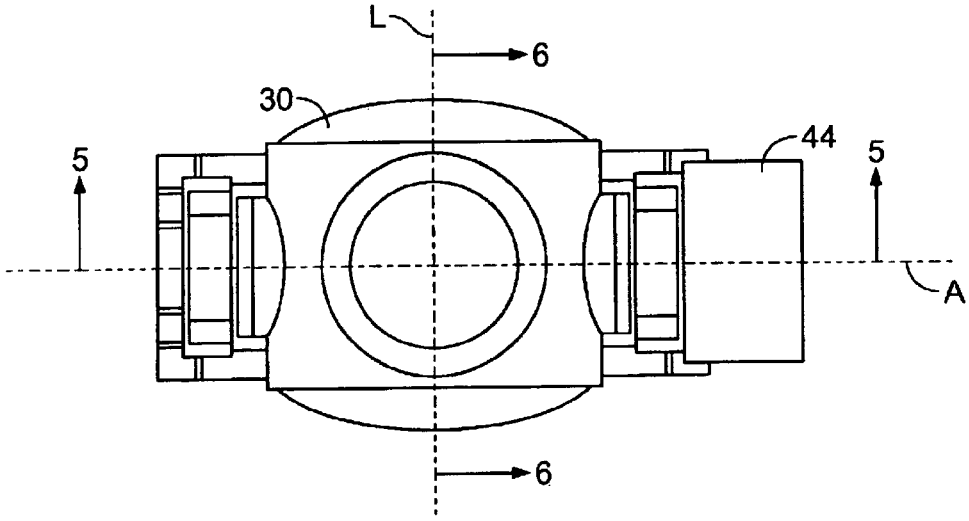
FIG. 4 is a plan view of the roll stabilizer.

FIGS. 1–3 show one possible implementation of a control moment gyro (CMG) or gyroscopic roll stabilizer 10 installed in a small boat 12. The boat shown is approximately 35 feet in length overall, but small boats of other lengths could make use of the roll stabilizer described herein. The roll stabilizers described herein will be of benefit to small boats because of their need for stabilization at low speed. The CMG stabilizer will also benefit ships, e.g., ships that spend large amounts of time at low speed such as coastal patrol boats.

The boat shown in FIGS. 1–3 has a planing hull, i.e., a hull that causes the boat to rise and generally ride along the surface of the water above a certain speed that is a function of the vessel's speed/length ratio. This behavior results largely from the underwater shape 14 of the hull and the dynamic forces acting on the hull as it increases speed. The roll motions of a planing boat are stabilized by these dynamic forces at planing speeds but the boat rolls substantially at zero and low speed because these forces are not present. Roll stabilizers as described herein are advantageous on boats with planing hulls because the stabilizer performs well at zero and low speed where it is needed. The roll stabilizers described herein will also be of benefit to other boat designs, including displacement hulls. A powerboat is shown in the figure, but the roll stabilizer can be applied to sailboats, as well.

Figures 8, 9A, 9B, 9C, 9D, 9E, 10A, 10B, 10C, 10D, 10E:
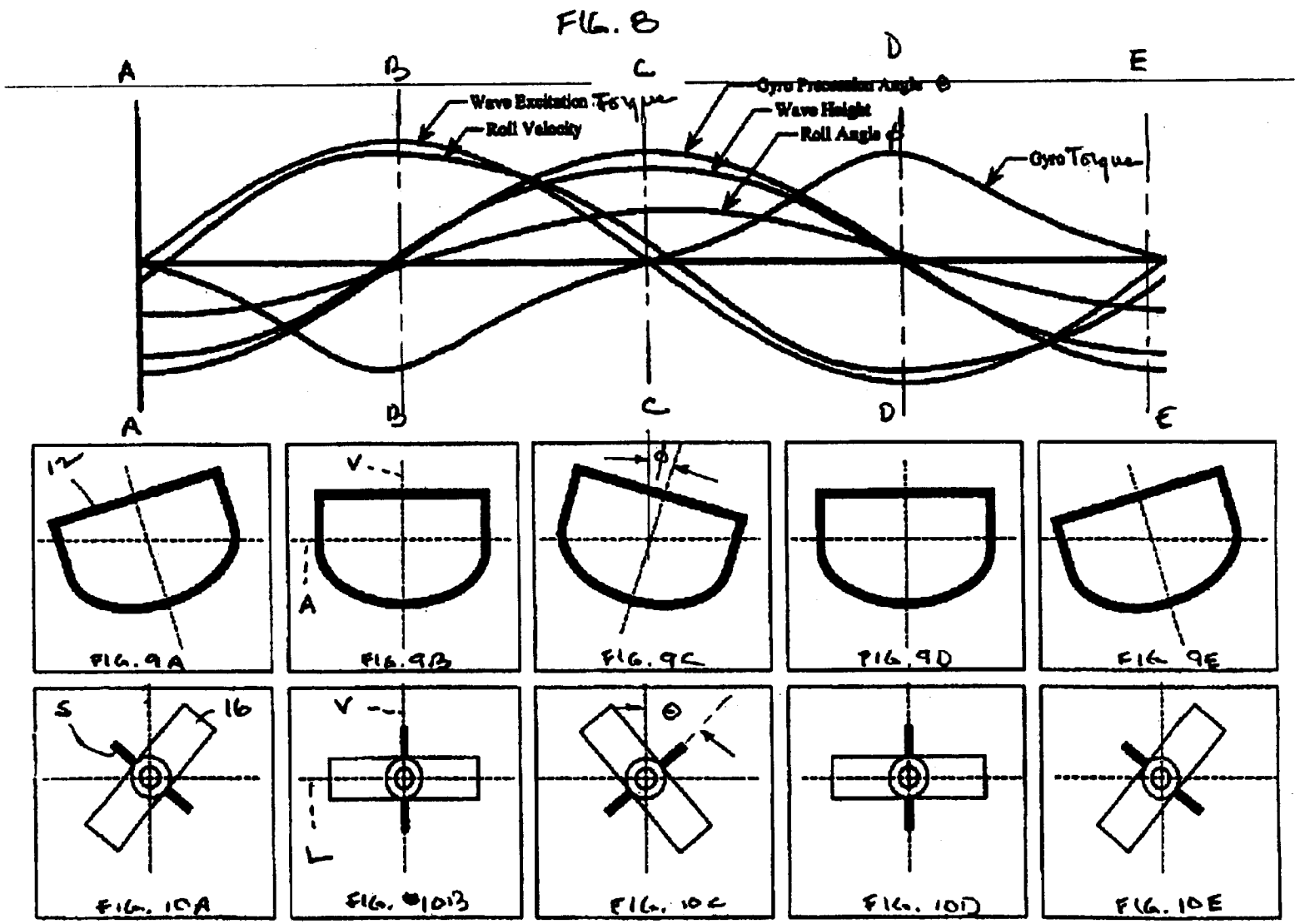
FIG. 8 is a plot of several parameters during one period of rolling motion while the roll stabilizer is functioning.
FIGS. 9A, 9B, 9C, 9D, and 9E are diagrammatic sketches of the orientation of the boat (end view as in FIG. 3) at times A, B, C, D, and E during the period of rolling motion shown in FIG. 8.
FIGS. 10A, 10B, 10C, 10D, and 10E are diagrammatic sketches of the orientation of the control moment gyro at different precession angles (view looking athwartship, as in FIGS. 2 and 5).
Figure 9A:
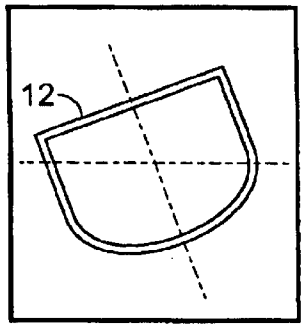
Figure 9B:
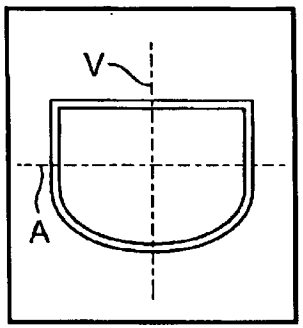
Figure 9C:
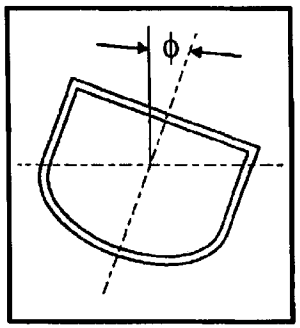
Figure 9D:
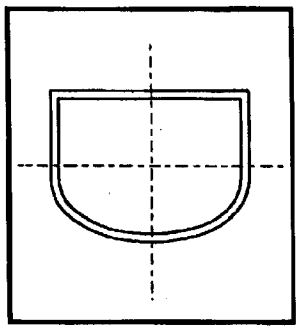
Figure 9E:
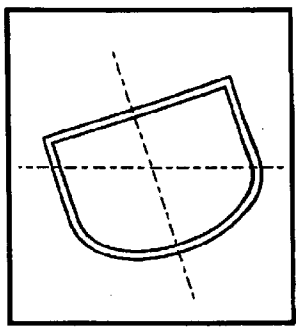
Figure 10A:
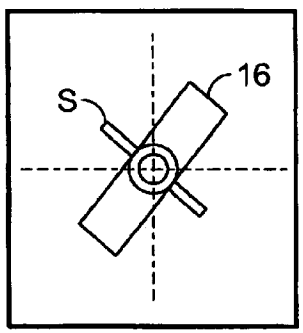
Figure 10B:
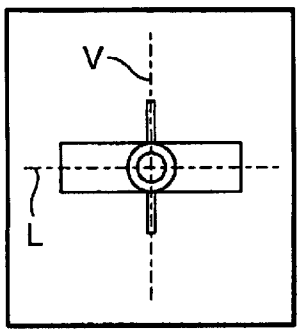
Figure 10C:
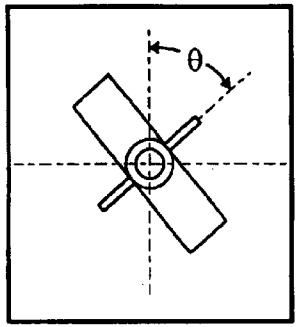
Figure 10D:
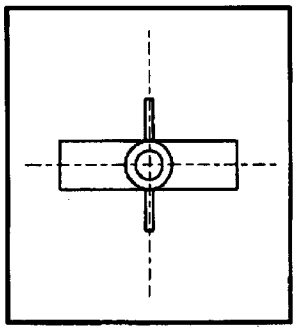
Figure 10E:
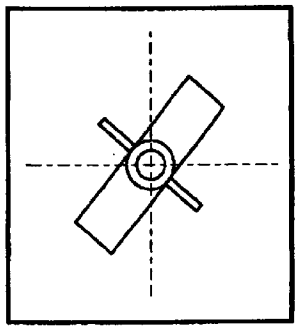

The boat shown in FIGS. 1–3 has a longitudinal axis L, about which the boat can roll through an angle $\phi$ (see FIG. 9C). The roll stabilizer could be installed at various locations on the boat, but is preferably situated along the centerline or longitudinal axis.

Figure 5:
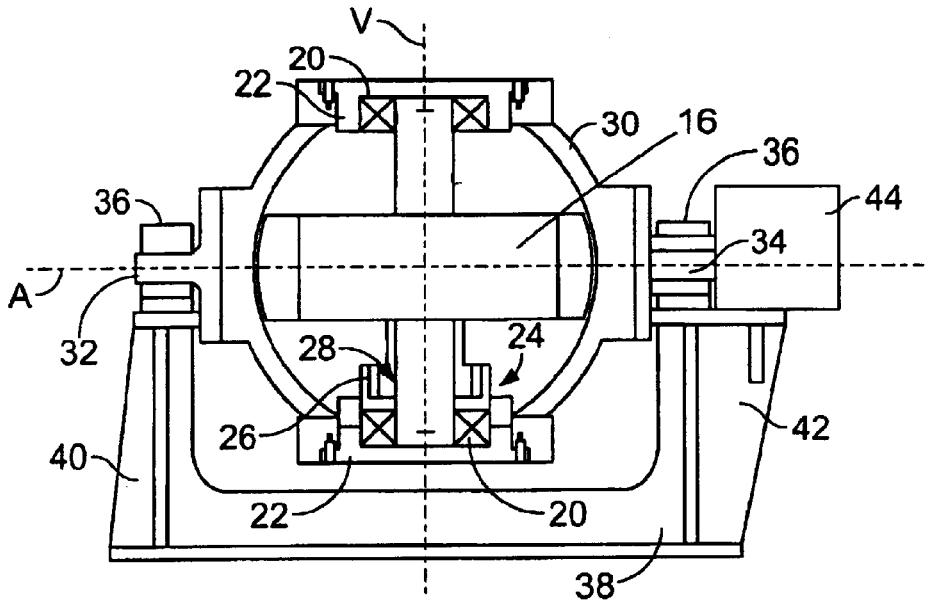
FIG. 5 is a cross sectional view taken along 5—5 in FIG. 4.
Figure 6:
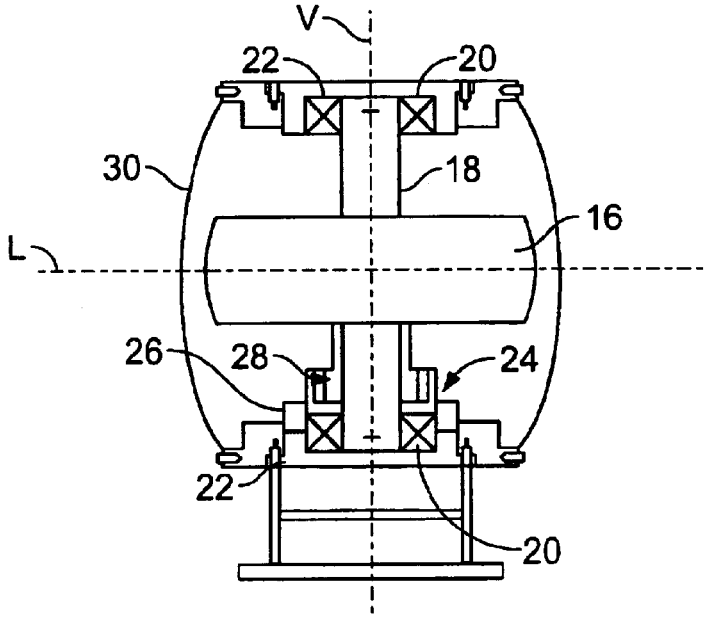
FIG. 6 is a cross sectional view taken along 6—6 in FIG. 4.

The roll stabilizer 10 includes a flywheel 16 (FIG. 5 and 6) that spins about a spin axis V. A flywheel support structure supports the flywheel assembly so that it can spin at a high angular velocity (spin rate) about the spin axis. Various forms of support structure could be used. In the example shown, the flywheel assembly includes a flywheel, shaft, spin motor and bearings. The bearings 20 at each end of the shaft 18 are supported within bearing housings 22 mounted in an enclosure 30.

The flywheel is rotated at a high angular velocity by a flywheel drive motor 24. The flywheel drive motor could be provided in many different forms. In the example shown, the motor is at one end of the flywheel shaft, and includes a stator 26 fastened to the enclosure and a rotor 28 fastened to the shaft. Various forms of motors could be used as the flywheel drive motor.

An enclosure 30 surrounds the flywheel. In some implementations, the enclosure is configured to maintain a below-ambient pressure within its interior, so that the flywheel spins in a below ambient pressure, and thus with less aerodynamic drag than would be the case were it to spin at ambient pressure. In other implementations, a below-ambient density gas (e.g., helium) is contained within the enclosure, also for the purpose of reducing aerodynamic drag. Below-ambient pressure and below-ambient density could both be employed simultaneously, or used independently (e.g., a below-ambient gas at ambient pressure or an ambient-density gas at below-ambient pressure), as either can assist in reducing aerodynamic drag. In those implementations in which the enclosure maintains a below-ambient pressure, the pressure is preferably below 190 torr (0.25 atmosphere), and more preferably below 7.6 torr (0.01 atmosphere). Even lower aerodynamic drag on the flywheel can be achieved if the sealed enclosure maintains the flywheel at a low vacuum, i.e., pressure below 1 torr (0.0013 atmosphere). An ultra high vacuum, e.g., less than $10^{-6}$ torr ($10^{-9}$ atmosphere), such as would be encountered in spacecraft applications would work, but is not necessary.

The mechanical construction of the enclosure can vary from what is shown in the figures. The flywheel support structure and flywheel drive motor can be within or outside of the enclosure. The enclosure can be generally spherical as shown in the figures, or of another shape. Conceivably, only a portion of the flywheel (e.g., its outer periphery) could be within the sealed enclosure. The objective is to enclose the rapidly moving portion of the flywheel within the enclosure to reduce aerodynamic drag.

Preferably, the flywheel is driven at high tip speeds—above 650 ft/sec on ships, and above 450 ft/sec on small boats. More preferably, the tip speed on small boats is above 650 ft/sec, and most preferably above 850 ft/sec. The enclosure's maintaining a below ambient pressure and/or below ambient density makes the higher tip speeds possible. Still higher tip speeds (e.g., 1200 to 1500 ft/sec) may provide improved performance. Provision for cooling the flywheel bearings may be necessary at very high tip speeds.

Figure 11:
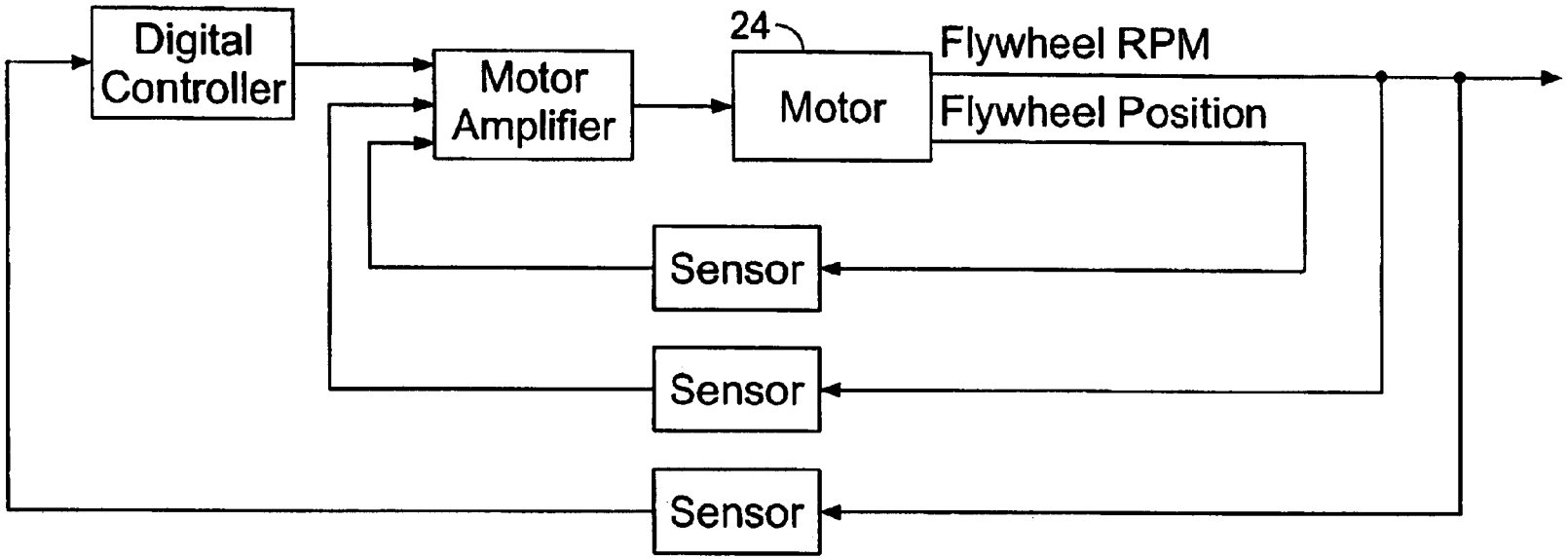
FIG. 11 is a block diagram of a system for controlling the spin rate (rpm) of the CMG flywheel.
Figure 8:
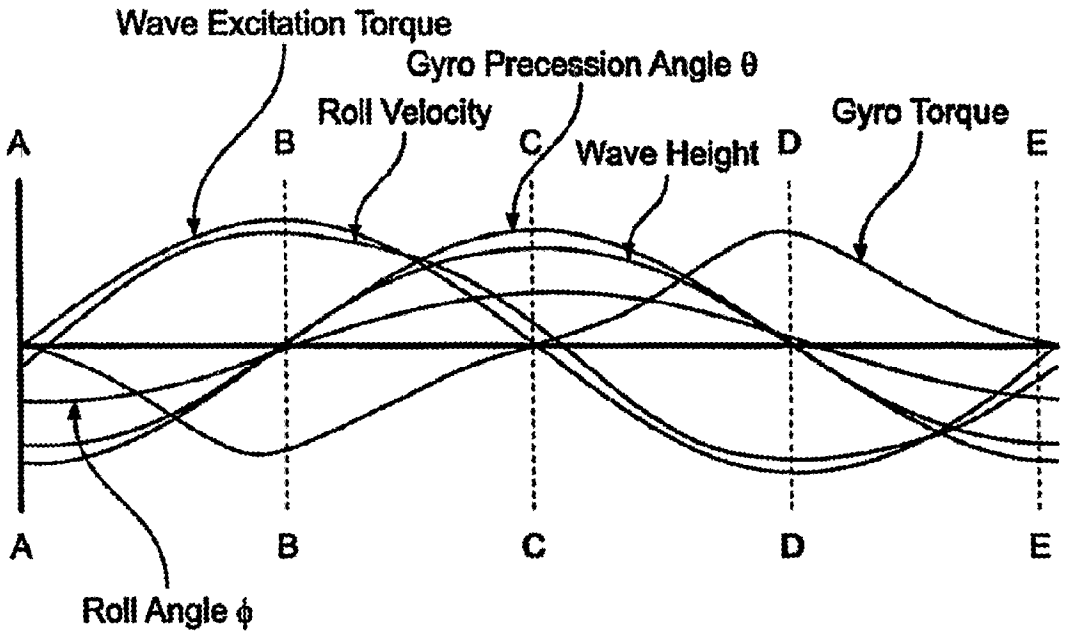

An active control system (FIG. 11) is used to control spin rate (rpm) and tip speed. The control system includes an rpm sensor, whose output is fed to a controller that controls the flywheel drive motor. Actively controlling the flywheel rpm prevents over speed of the flywheel (as could occur absent active control in that aerodynamic friction might, at least in some implementations, be sufficiently low that it would not inherently limit rpm to a desired level).

The angular inertia of the flywheel is preferably maximized, and thus much of the mass of the flywheel is located at its perimeter. But structural and aerodynamic drag considerations must be considered in choosing its shape. The more that aerodynamic drag can be reduced by reducing the pressure and/or density, the more flexibility there is in shaping the flywheel.

A gimbal structure supports the flywheel enclosure so that the flywheel can rotate ("precess") about a gimbal axis that is perpendicular to the spin axis. In the implementation shown in the figures, the gimbal axis extends athwartship, and the spin axis of the flywheel (at zero precession angle) is vertical, so that both are perpendicular to the longitudinal axis of the boat. The spin axis is able to process about the athwartship gimbal axis, resulting in the spin axis tilting forward or aft (as shown, for example, in FIGS. 10A, 10C) in a vertical plane that passes through the longitudinal axis of the boat. The gimbal structure includes gimbal shafts 32, 34 extending from each side of the flywheel enclosure (in the figures the shafts extend from the enclosure, but other arrangements are possible). Gimbal bearings 36 support the gimbal shafts. A base frame 38 with vertically extending support arms 40, 42 provide support for gimbal bearings 36.

A device 44 is provided for applying a torque ("gimbal torque") to the flywheel about the gimbal axis. In the implementation shown in the figures, the torque is applied to one of the gimbal shafts, and thereby to the flywheel support structure and flywheel. At least three broad categories of devices can be used to provide the gimbal torque. A first category of devices includes passive brakes, which do not require external energy for operation. Typically, passive brakes oppose motion in a constant manner that is in proportion to the angular velocity, but the braking torque can be applied in many different ways depending on brake construction. A hydraulic or fluidic rotary motion damper or dashpot could also be used. But other braking mechanisms are possible, including any of a wide variety of devices operating on mechanical and/or hydraulic principles, and using linear and/or rotary motion dampers using hydraulic, gas, or elastometric principles.

A second category of device for applying a gimbal torque includes devices that actively brake or damp rotation (precession) about the gimbal axis by varying the braking or damping torque as a function of any of various parameters, including, for example, one or more of roll acceleration, roll rate, roll angle, precession acceleration, precession rate, and precession angle. Sensors measure the parameter, and provide an electrical signal representative of the parameter to a control system, which, in turn, controls a physical device that applies a torque about the gimbal axis. A wide variety of types of physical devices could apply that torque, including, for example: hydraulic linear or rotary actuators applied in a rotary damping mode where the fluid resistance is actively controlled, mechanical brakes such as drum brake and disc brakes wherein the braking friction is actively controlled using hydraulic or electrical power, magnetic brakes and electromagnetic brakes wherein electricity and/or magnetic principals are used to actively control the braking torque, and/or electrical brakes such as a generator wherein the generator load is actively controlled to vary the damping torque.

A third category of device for applying a gimbal torque includes devices that actively initiate precession (in advance of the control moment gyro's natural tendency to precess). Such devices typically follow active initiation of precession with active braking or damping of the precession as discussed in the preceding paragraph. A wide variety of types of devices could be used to perform this function, including, for example: a motor/generator pair as first proposed by Sperry (see discussion in Ferry, *Applied Gyrodynamics*), electro-hydraulic linear or rotary servo actuator or motor, and/or electrical servo actuator or motor.

Whatever category of brake is employed, the braking device may be regenerative. The energy removed from the flywheel precession may be stored and used to spin the flywheel or actively initiate precession. U.S. Pat. Nos. 1,236,204, 1,558,720, and 1,640,549.

Figure 7:
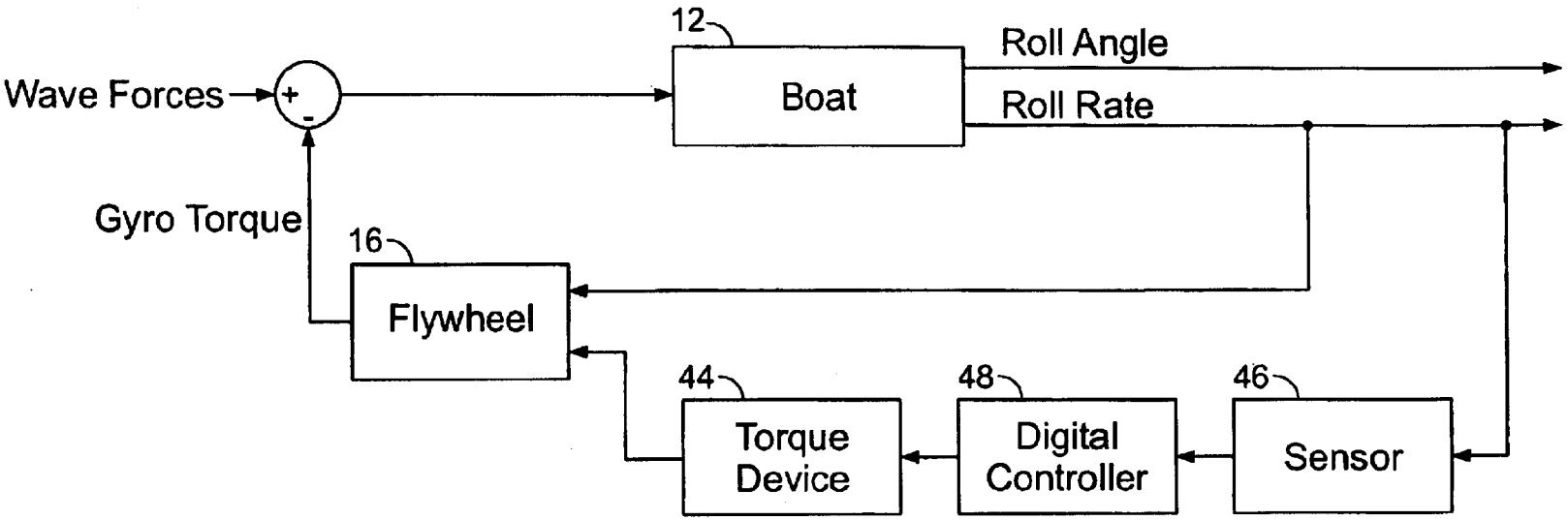
FIG. 7 is a block-diagram of the control system for operating the control moment gyro roll stabilizer.

FIG. 7 is a block diagram showing in general terms one possible control system for implementing the second or third category of devices. Wave forces applied to the boat 12, provide a torque about the longitudinal axis of the boat, resulting in a rolling motion, which can be characterized by a roll angle and roll rate (there will also, of course, be a roll acceleration not shown in the figure). The roll rate of the boat creates a precession torque about the gyro's gimbal axis. A sensor 46 (FIGS. 1, 2) measures the boat's roll rate (or roll acceleration, which is integrated to provide roll rate) and the measured roll rate is fed to an electronic controller 48, which controls the device 44 for applying a torque about the gimbal axis. By controlling the amount of torque applied in opposition to the precession torque, the gyro is allowed to precess in a controlled manner and a gyroscopic torque is produced about the boat's longitudinal axis which damps or reduces the boat's roll motions.

A great many other possibilities exist for the control system, many of which would be more complex than that shown. As mentioned, a great many other parameters could be measured with additional or different sensors. These could be combined in various ways by the controller.

FIGS. 8, 9A–9E, and 10A–10E illustrate the operation of the control moment gyro roll stabilizer. The figures show the behavior of the boat in steady state, assuming that a sinusoidal wave excitation tending to cause roll has been applied long enough that a steady state behavior occurs (i.e., from one roll period to the next, the behavior is unchanged). This, of course, is only a theoretical situation, as a boat is not likely to be excited by a pure and unchanging sinusoidal wave excitation, but the figures are still helpful at illustrating the operation of the stabilizer. Those skilled in the art will appreciate how the behavior of the boat will vary under different, including more realistic, conditions.

FIGS. 9A–9E show the roll orientation of the boat at five times A–E during one period of roll motion (times A–E are separated by 90 degrees of phase). FIGS. 10A–10E show the precession angle about the gimbal axis of the flywheel at the same five times A–E. In these figures, the flywheel 16 is shown diagrammatically, with its spin axis S shown in dark lines. The roll angle $\phi$ of the boat can be seen in FIGS. 9A–9E, whereas the flywheel precession angle $\theta$ is shown in FIGS. 10A–10E.

FIG. 8 is a plot of six parameters versus time during the steady state roll period. One can see that roll velocity is nearly in phase with the wave excitation torque (the net torque about the longitudinal axis owing to wave action), and nearly 180 degrees out of phase with the gyro torque (the torque about the longitudinal axis applied by the control moment gyro roll stabilizer). The gyro torque is the torque resulting from the controlled rate of precession of the flywheel. As explained earlier, gyroscopic physics results in the gyro torque being a greatly amplified version of the gimbal torque (many times larger but in phase). The gyro torque is 180 degrees out of phase with, and thus tends to counter, the wave excitation torque. The roll angle $\phi$ and precession angle $\theta$ are approximately in phase, with maximum roll angle occurring at approximately the same times (C and E) as the maximum precession angle. Roll angle and precession angle are roughly 90 degrees out of phase with roll velocity and wave excitation moment. Wave height is approximately in phase with roll angle and precession angle.

Were it not for the gyro torque provided by the roll stabilizer, the roll angle and velocity would be much greater than that shown. The non-sinusoidal shape of the gyro torque curve results from the fact that the gimbal torque applied by device 44 is only at peak effectiveness when the precession angle is zero (times B and D). When the spin axis of the flywheel has precessed away from vertical (e.g., time C), the amount of gimbal torque that translates into gyro torque about the roll axis is reduced by the cosine of the precession angle. At these times, some of the gimbal torque translates into torque about the yaw axis.

Many other implementations other than those described above are within the invention, which is defined by the following claims. As mentioned earlier, it is not possible to describe here all possible implementations of the invention, but a few possibilities not mentioned above include the following: A plurality of control moment gyro roll stabilizers (instead of just the one shown in the figures) could be installed on a given boat. If an even number of flywheels are employed and they spin in opposite directions, then there will be no net torque about the yaw axis (Ferry, *Applied Gyrodynamics*). Power produced by braking or damping precession could be captured and used aboard the boat, e.g., to charge a battery, and/or power the flywheel drive motor, and/or power a cooling or lubrication circuit for the flywheel bearings. The CMG stabilizer could be combined with fin stabilizers or other roll stabilizing devices; e.g., the fin stabilizers could be relied on for roll stability underway, and the CMG stabilizer relied on for roll stability at rest or low speed. A variety of orientations and locations of the flywheel and gimbal axis are possible so long as the net effect is that the stabilizer damps roll motions of the boat. For example, the spin axis of the flywheel could be oriented athwartship rather than vertical, and the gimbal axis oriented vertically rather than athwartship.

Not all of the features described above and appearing in some of the claims below are necessary to practicing the invention. Only the features recited in a particular claim are required for practicing the invention described in that claim. Features have been intentionally left out of claims in order to describe the invention at a breadth consistent with the inventors' contribution. For example, although in some implementations, an enclosure surrounding some or all of the flywheel maintains a below-ambient pressure and/or contains a below-ambient density gas, such an enclosure is not required to practice the invention of some claims. Although in some implementations, minimum flywheel tip speeds are described, those minimum tip speeds are not required to practice the invention of some claims. Although in some implementations, the stabilizer is configured and sized for a small boat, the invention of some claims contemplates a stabilizer for a ship.

What is claimed is:

1. A gyroscopic roll stabilizer for a boat, the stabilizer comprising:

a flywheel;

a flywheel drive motor configured to spin the flywheel about a spin axis;

an enclosure surrounding a portion or all of the flywheel and maintaining a below-ambient pressure;

a gimbal structure configured to permit flywheel precession about a gimbal axis; and a device for applying a torque to the flywheel about the gimbal axis;

the flywheel, enclosure, and gimbal structure configured so that when installed in the boat the stabilizer damps roll motion of the boat.

2. A gyroscopic roll stabilizer for a boat, the stabilizer comprising: a flywheel;

a flywheel drive motor configured to spin the flywheel about a spin axis;

an enclosure surrounding a portion or all of the flywheel and containing a below-ambient density gas;

a gimbal structure configured to permit flywheel precession about a gimbal axis; and a device for applying a torque to the flywheel about the gimbal axis;

the flywheel, enclosure, and gimbal structure configured so that when installed in the boat the stabilizer damps roll motion of the boat.

3. The gyroscopic roll stabilizer of claim 1 wherein the stabilizer is configured and sized to be installed in a small boat.

4. The gyroscopic roll stabilizer of claim 2 wherein the stabilizer is configured and sized to be installed in a small boat.

5. The stabilizer of claim 3 or 4 wherein the flywheel drive motor is configured to spin the flywheel about a spin axis at a tip speed of at least 450 ft/sec.

6. The stabilizer of claim 5 wherein the flywheel drive motor is configured to spin the flywheel at a tip speed of at least 650 ft/sec.

7. The stabilizer of claim 6 wherein the flywheel drive motor is configured to spin the flywheel at a tip speed of at least 850 ft/sec.

8. The stabilizer of claim 1 or 3 wherein the enclosure maintains a below-ambient pressure of less than 190 torr (0.25 atmosphere).

9. The stabilizer of claim 8 wherein the enclosure maintains a below-ambient pressure of less than 7.6 torr (0.01 atmosphere).

10. The stabilizer of claim 9 wherein the enclosure maintains a below-ambient pressure of less than 1 torr (0.0013 atmosphere).

11. The stabilizer of claim 1 or 3 wherein the enclosure maintains a below-ambient pressure and contains a below-ambient density gas.

12. The stabilizer of claim 9 wherein the flywheel drive motor is configured to spin the flywheel at a tip speed of at least 650 ft/sec.

13. The stabilizer of claim 1, 2, 3, or 4 further comprising a sensor for determining the spin rate of the flywheel and a controller for using the determined spin rate to control the flywheel drive motor and automatically regulate the flywheel spin rate.

14. The stabilizer of claim 3 or 4 wherein the device for applying a torque comprises a passive precession brake.

15. The stabilizer of claim 3 or 4 wherein the device for applying a torque comprises an active precession brake.

16. The stabilizer of claim 3 or 4 wherein the device for applying a torque comprises a device for applying a torque to cause precession.

17. The stabilizer of claim 3 or 4 wherein the small boat has a planing hull.

* * * * *

UNITED STATES PATENT AND TRADEMARK OFFICE

CERTIFICATE OF CORRECTION

PATENT NO. : 6,973,847 B2
APPLICATION NO. : 10/454905
DATED : December 13, 2005
INVENTOR(S) : John D. Adams and Shepard W. McKenny It is certified that error appears in the above-identified patent and that said Letters Patent is hereby corrected as shown below:

Drawings, replace sheet 5 of 7 with the attached replacement sheet.

Column 2, line 58, “process” should be -- precess --.

Column 3, line 12, “modem” should be -- modern --.

Column 7, line 52, “process” should be -- precess --.

Signed and Sealed this

Seventh Day of November, 2006

JON W. DUDAS
*Director of the United States Patent and Trademark Office*

US006973847C1

(12) EX PARTE REEXAMINATION CERTIFICATE (10199th)

United States Patent

Adams et al.

(10) Number: US 6,973,847 C1

(45) Certificate Issued: Jun. 25, 2014

(54) GYROSCOPIC ROLL STABILIZER FOR BOATS

(75) Inventors: John D. Adams, Lusby, MD (US); Shepard W. McKenney, Drayden, MD (US)

(73) Assignee: Seakeeper, Inc., Solomons, MD (US)

Reexamination Request:
No. 90/012,933, Aug. 9, 2013

Reexamination Certificate for:

| | |
|---|---|
| Patent No.: | **6,973,847** |
| Issued: | **Dec. 13, 2005** |
| Appl. No.: | **10/454,905** |
| Filed: | **Jun. 4, 2003** |

Certificate of Correction issued Nov. 7, 2006

(51) Int. Cl.
*G01C 19/30* (2006.01)

(52) U.S. Cl.
USPC ..... 74/5.47; 74/5.55; 114/121

(58) Field of Classification Search
USPC ..... 74/5.47, 5.22; 114/121
See application file for complete search history.

(56) References Cited

To view the complete listing of prior art documents cited during the proceeding for Reexamination Control Number 90/012,933, please refer to the USPTO's public Patent Application Information Retrieval (PAIR) system under the Display References tab.

*Primary Examiner* — Matthew C. Graham

(57) ABSTRACT

A gyroscopic roll stabilizer for a boat. The stabilizer includes a flywheel, a flywheel drive motor configured to spin the flywheel about a spin axis, an enclosure surrounding a portion or all of the flywheel and maintaining a below-ambient pressure or containing a below-ambient density gas, a gimbal structure configured to permit flywheel precession about a gimbal axis, and a device for applying a torque to the flywheel about the gimbal axis. The flywheel, enclosure, and gimbal structure are configured so that when installed in the boat the stabilizer damps roll motion of the boat. Preferably, the flywheel drive motor spins the flywheel at high tip speeds.

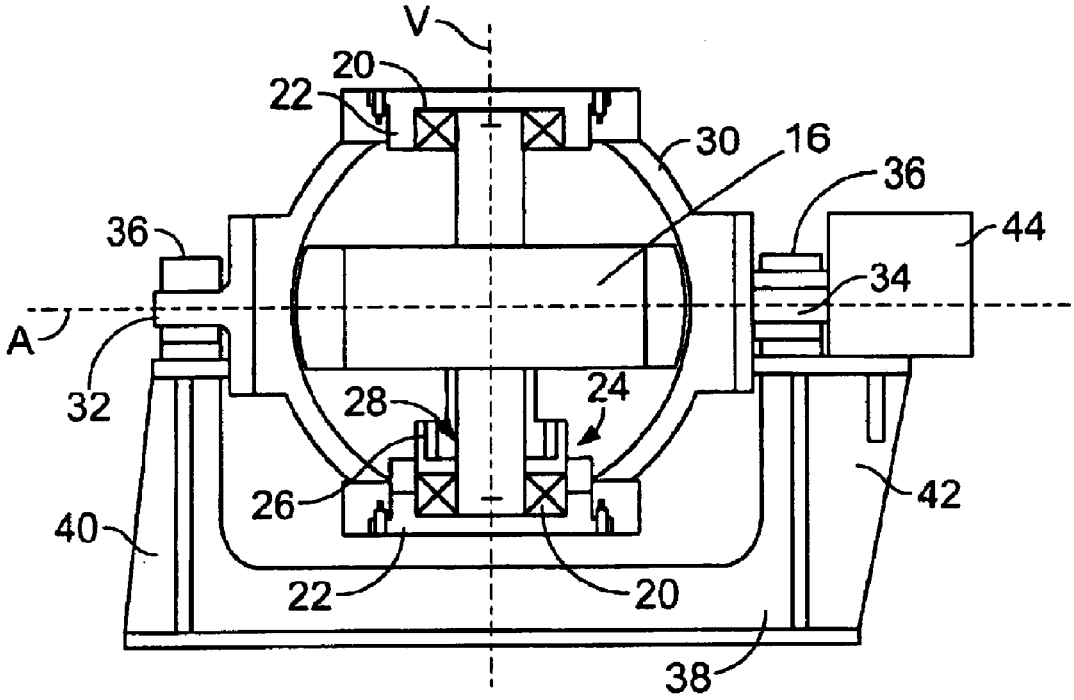

EX PARTE REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

Claims 2, 4 and 11 are cancelled.

Claims 1, 5, 8, 9, 10, 13, 14, 15, 16 and 17 are determined to be patentable as amended.

Claims 3, 6, 7 and 12, dependent on an amended claim, are determined to be patentable.

New claim 18 is added and determined to be patentable.

1. A gyroscopic roll stabilizer for a boat, the stabilizer comprising:

a flywheel;

a flywheel drive motor configured to spin the flywheel about a spin axis;

an enclosure surrounding a portion or all of the flywheel and maintaining [a below-ambient pressure] *at least a partial vacuum and containing a gas that is lighter than air*;

a gimbal structure configured to permit flywheel precession about a gimbal axis; and a device for applying a torque to the flywheel about the gimbal axis;

the flywheel, enclosure, and gimbal structure configured so that when installed in the boat the stabilizer damps roll motion of the boat.

5. The stabilizer of claim 3 [or 4] wherein the flywheel drive motor is configured to spin the flywheel about a spin axis at a tip speed of at least 450 ft/sec.

8. The stabilizer of claim 1 [or 3] wherein the enclosure maintains a [below-ambient pressure] *partial vacuum* of less than 190 torr (0.25 atmosphere).

9. The stabilizer of claim 8 wherein the enclosure maintains a [below-ambient pressure] *partial vacuum* of less than 7.6 torr (0.01 atmosphere).

10. The stabilizer of claim 9 wherein the enclosure maintains a [below-ambient pressure] *partial vacuum* of less than 1 torr (0.0013 atmosphere).

13. The stabilizer of claim 1 [, 2, 3, or 4] further comprising a sensor for determining the spin rate of the flywheel and a controller for using the determined spin rate to control the flywheel drive motor and automatically regulate the flywheel spin rate.

14. The stabilizer of claim 3 [or 4] wherein the device for applying a torque comprises a passive precession brake.

15. The stabilizer of claim 3 [or 4] wherein the device for applying a torque comprises an active precession brake.

16. The stabilizer of claim 3 [or 4] wherein the device for applying a torque comprises a device for applying a torque to cause precession.

17. The stabilizer of claim 3 [or 4] wherein the small boat has a planing hull.

*18. The stabilizer of claim 1 wherein the gas is helium.*

* * * * *